United States Patent [19]

Shaffer

[11] Patent Number: 5,018,708

[45] Date of Patent: May 28, 1991

[54] WINCH APPARATUS

[75] Inventor: James E. Shaffer, Maitland, Fla.

[73] Assignee: Consulier Engineering, Inc., Riviera Beach, Fla.

[21] Appl. No.: 484,115

[22] Filed: Feb. 23, 1990

Related U.S. Application Data

[63] Continuation-in-part of Ser. No. 458,149, Feb. 28, 1989.

[51] Int. Cl.[5] ..... B66D 1/00

[52] U.S. Cl. ..... 254/266; 254/213; 254/342

[58] Field of Search ..... 24/68 CD, 71.1, 71.2; 242/100.1; 254/342, 344, 266, 213

[56] References Cited

U.S. PATENT DOCUMENTS

| | | | |
|---|---|---|---|
| 1,729,262 | 9/1929 | Chappelka | 254/342 |
| 3,468,175 | 9/1969 | Rabek | 74/63 |
| 3,507,159 | 4/1970 | Batty | 74/63 |
| 4,249,682 | 2/1981 | Yasue et al. | 254/266 X |
| 4,544,136 | 10/1985 | Denman et al. | 254/342 X |
| 4,625,947 | 12/1986 | Denman et al. | 254/342 X |
| 4,713,985 | 12/1987 | Ando | 74/804 |
| 4,736,654 | 4/1988 | Ren | 74/804 |

*Primary Examiner*—Dirk Wright
*Attorney, Agent, or Firm*—Warren L. Franz

[57] ABSTRACT

A winch suitable for construction in a pocket-sized version for lightweight winching operations has a rotatable spool assembly slidingly received between horizontal guide rails of a cage having oppositely disposed vertical sideplates joined by upper and lower dowels. A load-carrying strap is wrapped around a drum of the spool, with upper and lower strap ends respectively passing tangentially off the drum around opposite sides of the upper and lower dowels. An intermediate point of the strap wraps around a third dowel joining the spool flanges at an interval from the drum, so that as the spool is rotated the strap will be double-wrapped about the drum to shorten the distance between its ends. Compact construction is provided by an internal wave gear speed reduction mechanism that enables rotation of the spool drum at a speed less than rotation of a central drive shaft. The shaft has a square bore to be turned by passing a sprocket wrench driver through aligned bores of the cage sideplates. The sideplate bores have straight sides to prevent turning the driver when the spool is off center.

19 Claims, 4 Drawing Sheets

WINCH APPARATUS

CROSS-REFERENCE TO RELATED APPLICATIONS

This application is a continuation-in-part of commonly-owned, copending U.S. patent application Ser. No. 07/458,149 filed Dec. 28, 1989, entitled "Wave Gear Worm Drive," and still pending, and includes subject matter related to the subject matter of Applicant's commonly-owned, U.S. patent application Ser. Nos. 07/484,064 (entitled "Walking Chain Drive") and 07/483,929 (entitled "Wave Gear Linear Drive"), filed on even date herewith and both still pending. The disclosures of these applications are incorporated herein.

BACKGROUND OF THE INVENTION

This invention relates to an improved winch in general; and, in particular, to a winch arrangement that lends itself to construction in a pocket-sized version which is readily portable and suitable for lightweight winching operations.

The term "winch" as used herein, refers to a winch, hoist, block and tackle or similar mechanism having a structural housing member including a drum, pulley or sheave (hereafter called "drum") about which a flexible linear member, such as a chain, cable, rope or strap, is wrapped, wound or similarly perimetrically or peripherally extended (hereafter "wrapped") for the purpose of hoisting, lowering or hauling a load. A winch of this type may, for example, take the form of a hand-cranked spool-like drum rotatably carried on a shaft or pin mounted between opposite sideplates or cheeks of the supporting structure and about which a single turn of a cable linear member is wrapped, or may take the form of a housing having multiple, motor-driven sprocketed pulleys about which multiple turns of a chain linear member are wrapped.

Of particular interest to the invention is a winch of the type wherein means is provided to fix a point of the linear member to a point on the drum for rotation therewith, so that rotation of the drum causes an increase or decrease in the number of turns of the linear member about the drum, with a resulting raising or lowering of a load fixed relative to another point of the linear member remotely-positioned away from the drum.

In a usual conventional winch arrangement of this type, one end of the linear member is secured to the winch housing or drum and the other free end of the linear member serves to mount the load, such as by means of a hook. The drum is rotated either by hand-cranking or motor driving a drum shaft. The housing is fixed to external supporting structure, which may be a frame of a building or a gantry. The weight of the load in such an arrangement is supported by the housing, as well as by the linear member.

One aspect of the present invention relates to a new load bearing arrangement for a winch, whereby the entire load may be carried by the linear member, and protection against load dropping due to slippage is provided.

Winch arrangements of the type to which the invention relates will also normally include mechanical reduction gearing of some kind or other for transferring the motion between the crank arm or motor output drive shaft and the drum at a given speed reduction ratio. A typical configuration utilizes a conventional toothed, meshing gear train positioned between the drive shaft and the drum shaft. Such gearing is normally external to the drum and therefore increases the size of the winch.

Another aspect of the present invention relates to a new reduction gearing arrangement between the drum and the crank arm or motor shaft which permits the establishment of a very compact winch configuration.

Of relevance to the mechanical gearing aspect of the invention are concentric motion transfer mechanisms, such as those described in Rabek U.S. Pat. No. 3,468,175 and Batty U.S. Pat. No. 3,507,159, which employ wave gear technology to transfer motion at a predefined speed reduction ratio between one of two cyclically undulated or cammed surfaces and an intermediate carrier of reciprocated oscillating members, such as rollers or balls. In Batty, for example (see Batty FIGS. 2 and 3), motion transfer between a cam mounted on a central drive shaft and a concentrically positioned cylindrical extension of an output shaft occurs by interaction between an elliptical external surface of the cam and an internal periodically undulated continuous cam track of a surrounding ring positioned concentrically annularly of the cylindrical extension. The extension is provided with a plurality of radially-directed apertures, evenly spaced at angularly-displaced locations thereabout and which provide guideways to confine a plurality of rollers for radially-directed, oscillatory motion respectively therein. The rollers are adapted to contact both the elliptical cam surface of the cam and the cam track of the ring. The cam track provides an annular array of evenly-spaced teeth separated by recesses. As the rollers are driven radially in and out by the inner cam surface, they are forced to move along the contour of the outer cam surface track which is fixed, thereby causing the output shaft cylindrical extension to be rotated according to a predetermined speed ratio.

In the described Batty embodiment, it is the outer ring that is held fixed while the apertured cylindrical extension which captures the rollers is permitted to move. It is recognized that if the cylindrical extension is held fixed and the outer ring permitted to move, the same motion transfer mechanism can be implemented with the rotating cam driving the outer ring. Rabek shows various embodiments (see, e.g., Rabek FIGS. 8 and 10) wherein a central cam is rotated to drive an outer ring. To Applicant's knowledge, however, such wave gear motion transfer technology has not heretofore been applied to a winch, as described herein.

SUMMARY OF THE INVENTION

It is an object of the present invention to provide an improved winch apparatus which permits a more compact winch construction and which is adaptable to a pocket-sized, readily transportable winch especially suitable for use in lightweight winching operations.

It is another object of the invention to provide improved means in a winch for winding a flexible linear member about a drum in an advantageous force applying arrangement.

It is a further object of the present invention to provide an improved winch apparatus wherein speed reduction motion transfer is effected in a compact way between a crank arm or motor drive shaft and a drum utilizing wave gear principles.

These and other objects, features and advantages of the invention are implemented in a winch, as described in greater detail below, including a housing having a radially apertured tubular connecting member, a drive member with an externally facing cam surface concentrically and rotatably mounted within the hollow of the tubular member, and a drum in the form of a spool annularly mounted about the connecting member and having an internally facing periodically undulated surface. Oscillating members, preferably in the form of rollers, are respectively captured in the apertures of the connecting member to traverse the cam surface to be respectively driven radially in harmonic reciprocation through the apertures of the connecting member by the drive member, and to simultaneously traverse the undulating surface to cause the spool to be driven in response to the reciprocation.

In another aspect of the invention the linear member, preferably in the form of a strap, is brought around the drum and fixed in positional relationship relative thereto at a point intermediate the ends of the linear member. One end of the linear member is attached to an external weight-supporting surface and a load is supported at the other end. As the drum is rotated, the strap wraps in double layers around the spool, shortening the vertical distance between the ends of the strap and thus raising the load. Provision is made for hand-cranking the spool using a conventional square-headed socket wrench driver, and the housing and spool drive shaft are relatively configured to protect against uneven rotation of the drum.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DESCRIPTION OF THE PREFERRED EMBODIMENTS

Figure 1:
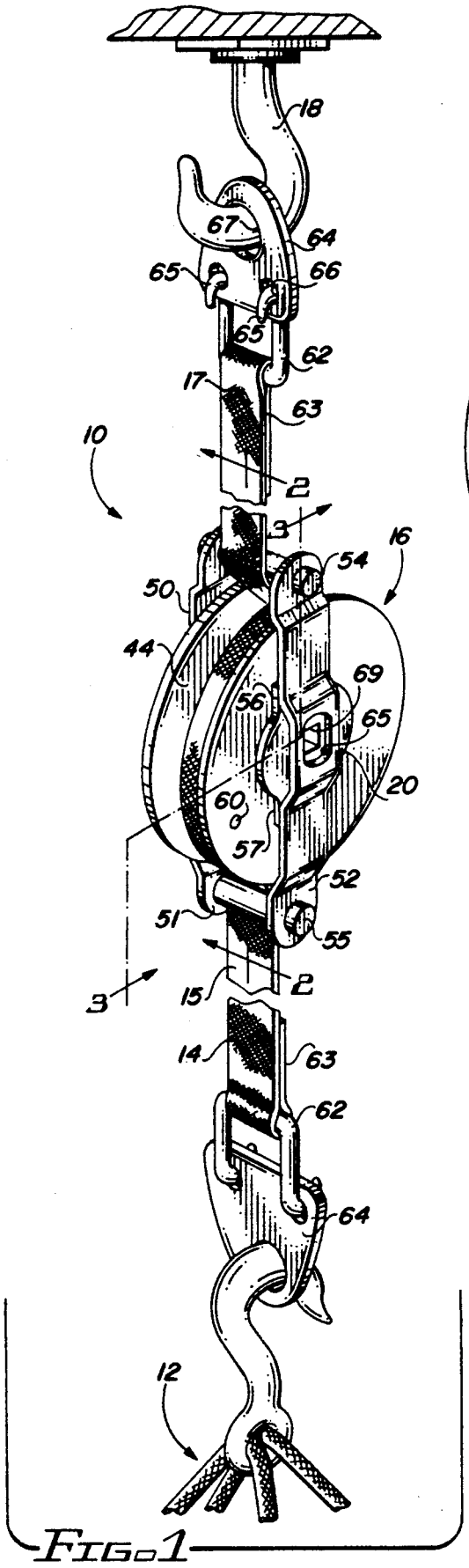
FIG. 1 is a perspective view of a winch apparatus in accordance with the principles of the invention.

The principles of the invention are illustrated by way of example, embodied in the form of a winch 10 (FIGS. 1–3) suitable for elevating and lowering a load 12 suspended at a free lower end 14 of a linear member, such as a strap 15, which is wrapped on a spool assembly 16 of the winch 10. The other, upper end 17 of the strap 15 is connected to a fixed external weight-supporting structure 18, and the member 15 is attached at an intermediate portion 19 (FIGS. 2, 3 and 5) to the assembly 16. Such an arrangement, described in further detail below, permits the downward force of the load 12 to be transmitted from the strap lower end 14 through the spool assembly 16 to the strap upper end 17 and the structure 18, without the requirement to fixedly support the assembly 16 itself.

Figure 4:
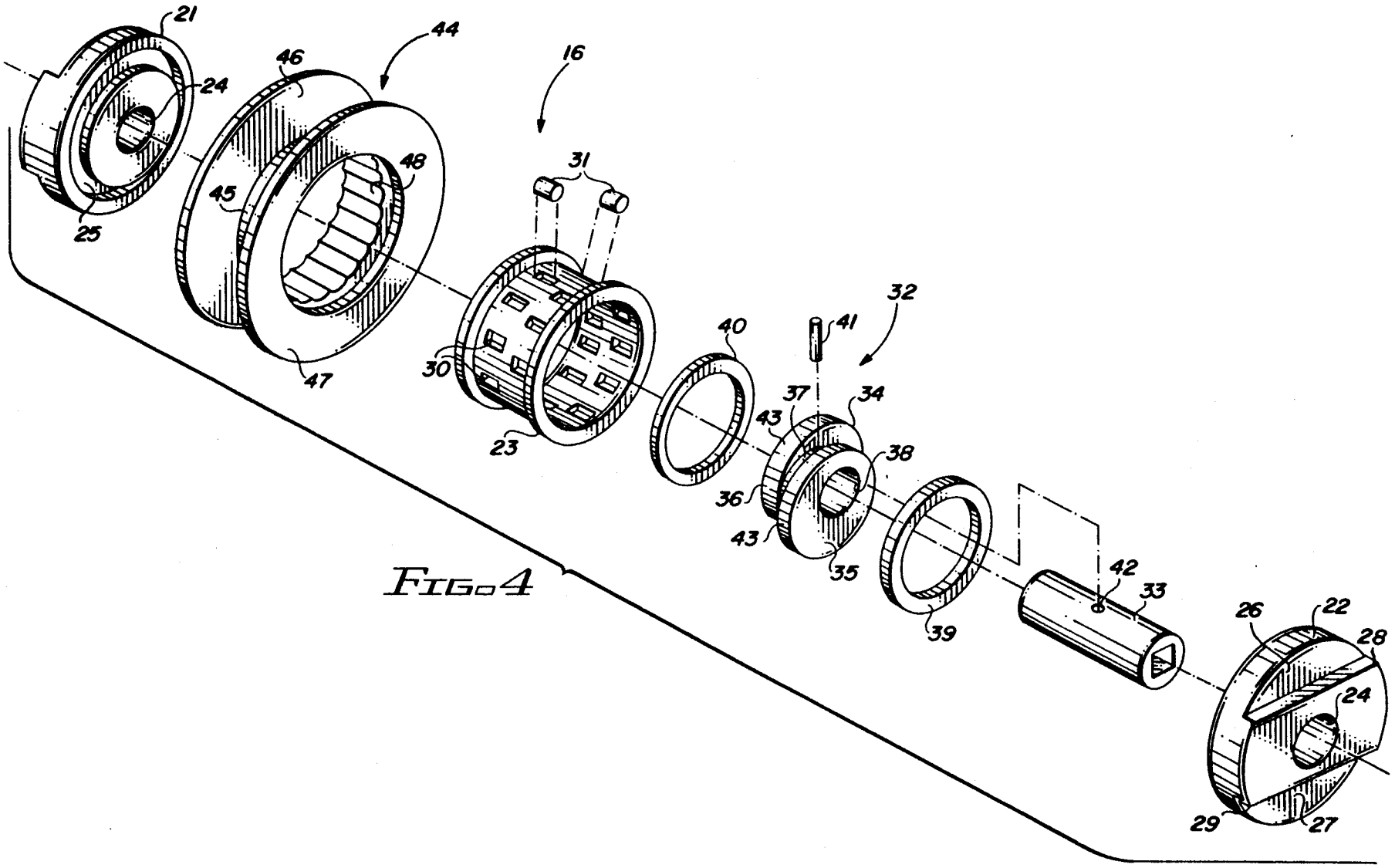
FIG. 4 is an exploded view of the spool assembly of the winch of FIG. 1.

FIG. 4 shows the elements of the spool assembly 16 in an exploded view. A housing 20 (see FIG. 1) comprises left and right hub halves 21, 22 and a tubular connecting portion 23. The hub halves 21, 22 have identical circular configurations with aligned central bores 24 and annular recesses 25 formed on inner faces thereof coaxially with the bores 24. The outer face of each hub half 21, 22 is cut away axially, part way through, at upper and lower approximately one-quarter circle segments 26, 27 on an outer face to form parallel, oppositely-facing surfaces 28, 29 along chord lines. The connecting portion 23 is circumferentially externally threaded at opposite ends for threaded interengagement with the recesses 25 to form a single unit of the hub halves 21, 22.

The connecting portion 23 has two axially-spaced runs of radially extending apertures 30 within which rollers 31 are respectively received. For the embodiment shown, the runs each comprise 12 slots evenly angularly-spaced based on 24 equal spacings about the circumference of the portion 23. The use of 12, rather than 24, roller slots 12 provides a stronger cage. (This recognition that a wave drive mechanism can have fewer than the full number of less by one or more by one slots and rollers is an advantageous feature of the invention.) The adjacent apertures 30 of the different runs are angularly staggered by a one-half pitch based on 24 pitches per run.

A drive member 32 (FIGS. 2 and 3) is rotatably mounted concentrically within the hollow interior of the portion 23. The member 32 comprises a shaft 33 about which is mounted a dual eccentric element 34 (FIG. 4). The shaft 33 is cylindrical and is fitted rotatably within the aligned bores 24 of the opposing hub halves 21, 22 to extend coaxially within the interior of the connecting portion 23 of the housing 20. The dual eccentric element 34 comprises two axially-spaced eccentric portions 35, 36 and an intermediate concentric portion 37. The element 34 is mounted about the periphery of the shaft 33 by means of an axial bore 38. The portions 35, 36 may be constituted by identical circular ring-shaped portions eccentrically mounted on the shaft 33, and the portion 37 may be constituted by a smaller diameter ring-shaped portion concentrically mounted on the shaft 33. The eccentricities of the portions 35, 36 are preferably 180° out of phase. Identical bearing rings 39, 40 are respectively mounted peripherally, circumferentially of the eccentric portions 35, 36. A shear pin 41 is extended through the central region 37 into a hole 42 in the shaft 33 to secure the element 34 for rotation therewith. The pin 41 acts to prevent lifting of loads 12 having weights greater than the intended capacity of the winch. The circular external surfaces of the bearing rings 38 eccentrically mounted on the shaft 33 present cyclically undulated surfaces in the form of outwardly facing one-toothed cam surfaces 43 respectively axially-aligned relative to each run of apertures 30. The use of rings 39, 40 alleviates relative motion between the cams represented by eccentric portions 35, 36 and the rollers 31. The use of dual eccentrics, 180° out of phase with each other, serves to advantageously balance the loading forces so that eccentric loading is minimized.

A spool 44, comprising a cylindrical drum 45 and left and right radially outwardly extending flanges 46, 47, is fitted coaxially annularly over the connecting portion 23. The drum 45 includes an inwardly facing cyclically undulated surface or cam track 48 providing an annular array of evenly-spaced teeth separated by recesses. In the shown embodiment, the track 48 presents a periodic array of 23 evenly angularly-spaced teeth suitably shaped, such as by combining circular recesses with angled straight line triangular outward projections.

Figure 5:
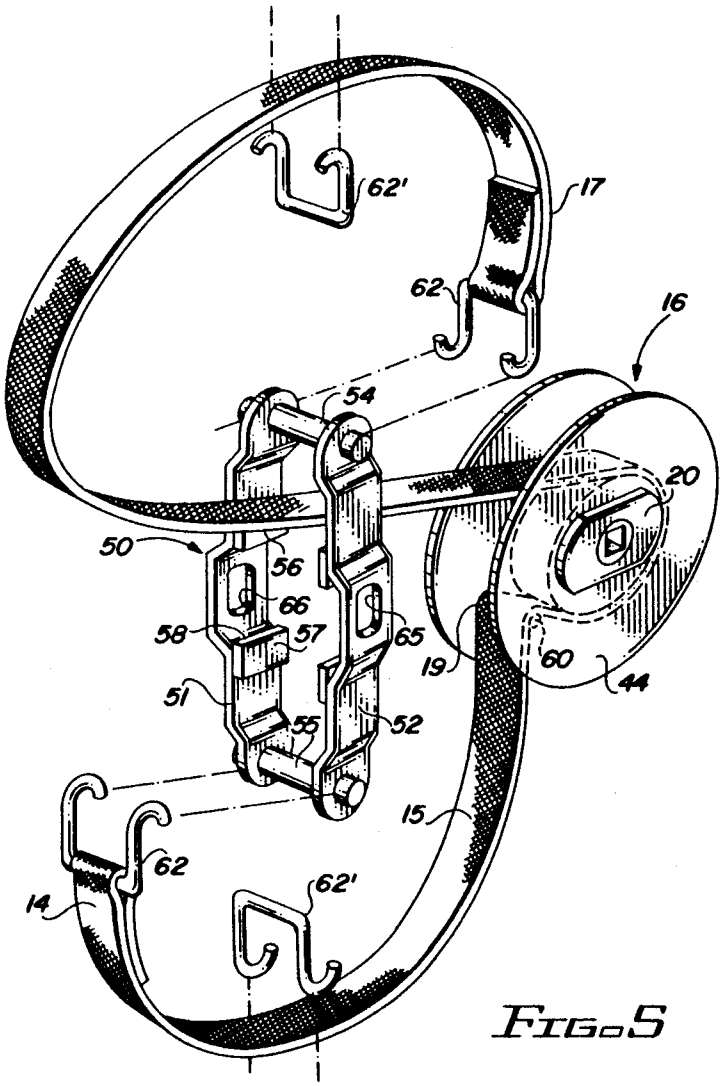
FIG. 5 is a perspective view showing the insertion of the spool assembly into the sideplate cage.

The spool assembly 16, thus configured, is slidably laterally received within a structural cage 50 (see FIG. 5) comprising generally vertically extending left and right elongated sideplates 51, 52 joined at upper and lower ends by laterally extending dowels 54, 55. Upper and lower parallel guide rails 56, 57 are positioned internally on an inside face of each of the sideplates 51, 52 to provide a horizontal channel 58 into which the surfaces 28, 29 of the hub halves 21, 22 can be snugly slidingly received, as indicated in FIG. 5. The guiderails function to maintain the vertical position of the assembly 16 relative to the cage 50.

Figure 3:
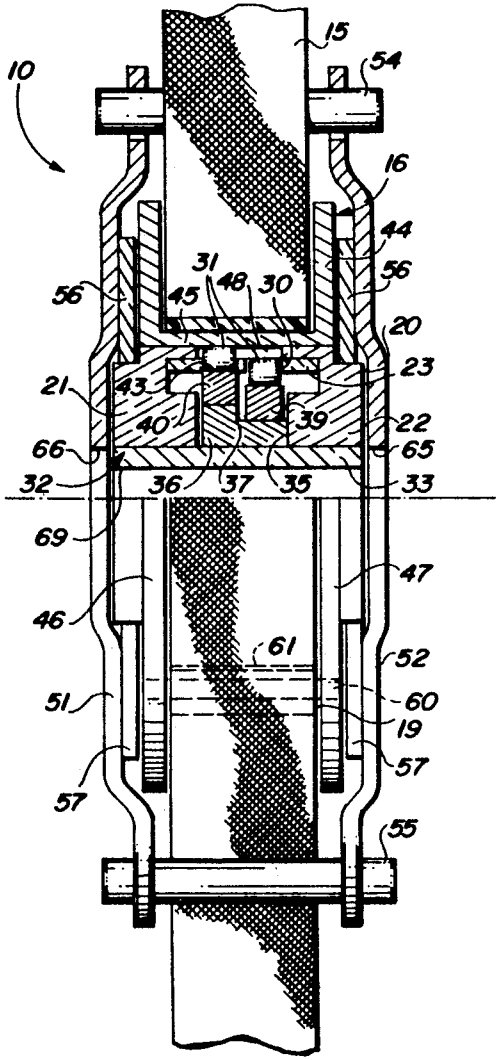
FIG. 3 is a view with the upper part in vertical central section taken along the line 3—3 of FIG. 1.

The spool assembly 16 includes means such as a dowel 60 extending laterally between flanges 46, 47, for fixing the position of the intermediate point 19 between the ends 14, 17 along the length of the linear strap member 15 to the drum 45. To bring the winch 10 into its operating position shown in FIG. 1, the spool assembly 16 is slid horizontally forward as indicated in FIG. 3, with the surfaces 28 and 29 contacting the rails 56, 57. The strap 15 is looped partway around the outside of the back of the drum 45 as indicated, for instance, by the dashed lines in FIG. 5. The upper end 17 is extended tangentially forwardly from the top of the drum 45 through the gap between the sideplates 51, 52 of the cage 50, and vertically upward around a front of the upper dowel 54. The lower end 14 is extended tangentially forwardly from the bottom of the drum 45 through the interval 61, around the top of the dowel 60, then down around the back of the lower dowel 55. Using U-shaped appliance hooks 62 which attach at loops 63 formed at backturned portions of the strap 15, or other suitable means, the load 12 (FIG. 1) can then be secured to the strap lower end 14 and the strap upper end 17 can be secured to the supporting structure 18.

Figure 6A:
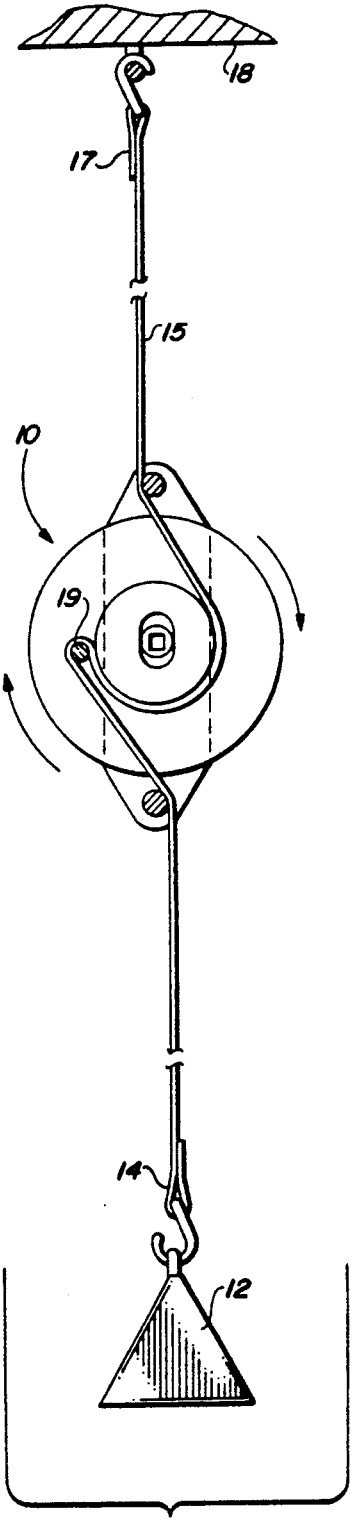
Figure 6B:
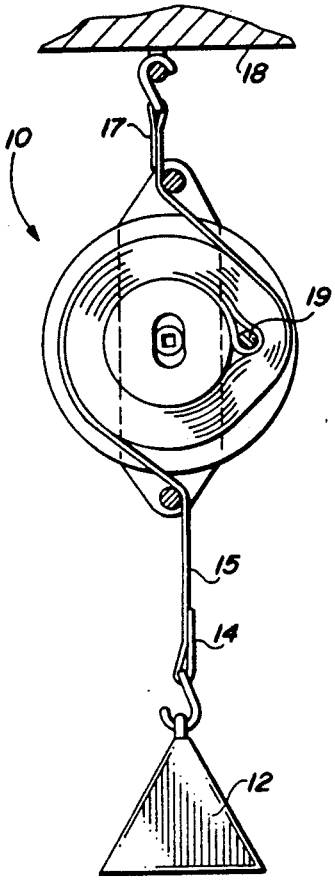

With the winch 10 thus assembled (see FIGS. 6A–6B), rotation of the shaft 33 by appropriate means, discussed below, will rotate the cam surfaces 43 of the drive member 32. Such movement will oscillate the rollers 31 radially within the apertures 30 of the connecting portion 23 rotationally fixed by the hub halves 21, 22 of the housing 20 to the cage 50 within the channel 58. Because the rollers 31 are in contact with both the cam surfaces 43 and the cam track 48, the oscillation of the rollers 31 contacting the cam track 48 of the drum 45 will cause the spool 44 to be driven in rotation at a predetermined speed reduction ratio about the shaft 33. As shown in FIGS. 6A–6B, as the shaft 33 is turned, the strap 15 will wrap in double layers around the outside of drum 45 to shorten the vertical distance between the ends 14, 17 of the strap 15, thereby lifting the load 12.

Figure 2:
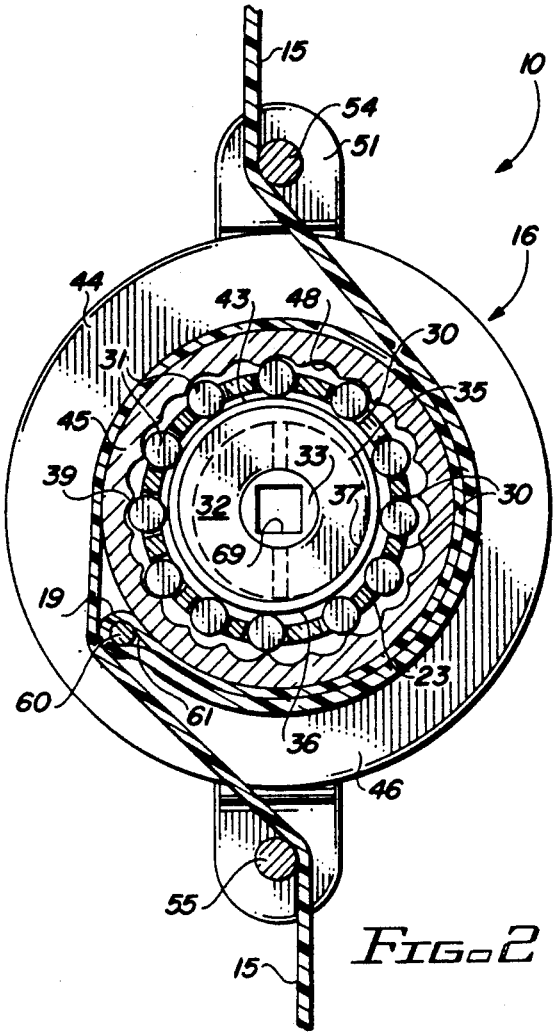
FIG. 2 is a section view taken along the line 2—2 of FIG. 1.

For the arrangement shown in FIG. 1, the upper end 17 is attached at a loop 63 by means of a U-shaped hook 62 and a flat triangular commodity attachment plate 64 to the rounded pointed end of a conventional hanger 66. The hook 62 has laterally spaced ends 65 which turn back on themselves and are brought into like spaced, first and second corner openings 66 of the plate 64. A larger opening 67 adjacent the third corner of the plate 64 is configured to receive the pointed end of the hanger 66. A similar accommodation is made with a plate 64 at the load bearing strap end 14.

Figure 7:
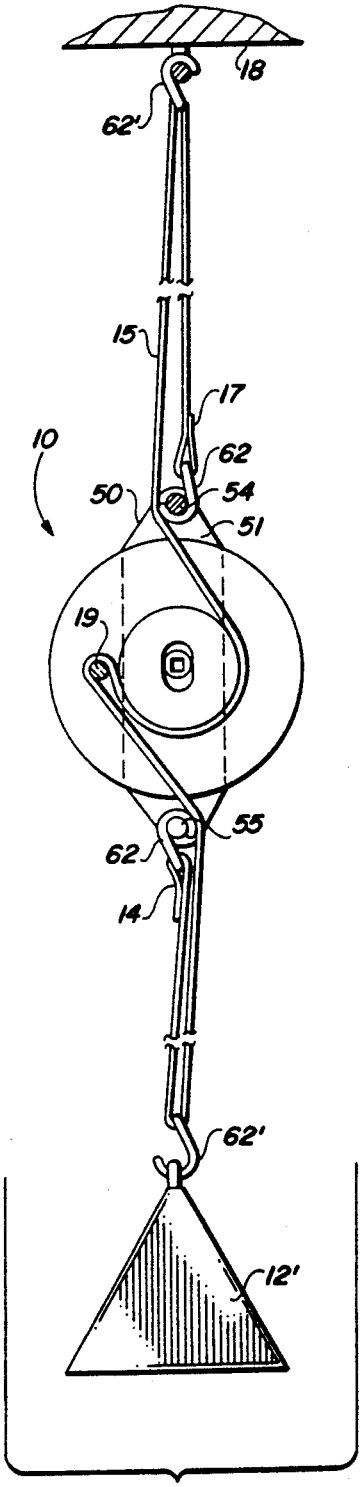

FIG. 7 shows an alternative attachment of the strap 15, hooked as suggested in FIG. 5, with the strap 15 doubled above and below the assembly 16 by hooking an end hook 62 at each end 14, 17 respectively over portions of dowels 54, 55 which project outwardly beyond the sideplates 51, 52. Additional hooks 61′ may be used to connect doubled upper and lower regions of the strap 15 to the structure 18 and a load 12′. This alternative attachment permits one-half the load 12′ to be carried through the outwardly directed portion of strap 15 that extends around the drum 45 and one-half to be carried through the backwards directed portion of strap 15 and the sideplates 51, 52, thereby enabling a load 12′ of twice the weight of load 12 to be raised or lowered.

Figure 8A:
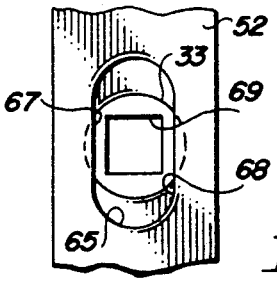
FIGS. 6A–6B, 7, and 8A–8B are schematic views helpful in understanding the operation of the winch and winching method.
Figure 8B:
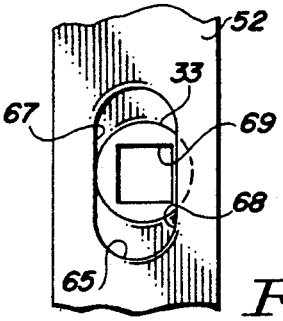

Should the drum begin to jam so that it becomes stationary relative to the dual eccentric 34, or should the spool assembly 16 begin to shift within the cage 50, a mechanism is provided to lock the position of the strap 15. As shown with reference to FIGS. 8A and 8B, aligned apertures 65, 66 are provided in the sideplates 51, 52 with opposing parallel straight sides 67, 68 just slightly larger than the diagonal extend of a square bore 69 coaxially formed in the shaft 33. The bore 69 is configured to permit the shaft 33 to be rotated by insertion of the square end of a common socket wrench driver (not shown) through one of the apertures 65, 66 into the bore 69 when the shaft 33 and, thus, the spool assembly 16 is centered within the cage 50 (see FIG. 8A). The driver acts as a crank shaft for the winch 10. However, should the assembly 16 be shifted horizontally due to drum imbalance or undesired load shifting, the straight edge of the driver will lock against one of the straight edge 67, 68 of the aperture 65, 66 (see FIG. 8B), thereby preventing further turning of the drum 45.

It will appreciated by those skilled in the art to which the invention relates that various substitutions and modifications may be made to the described embodiments without departing from the spirit and scope of the invention as described in the claims below.

What is claimed is:

1. A winch or the like, comprising:

a housing having oppositely disposed portions and a tubular connecting portion having inside and outside surfaces and joining said oppositely disposed portions;

a drive member rotatably mounted on said housing and having a first cyclically undulated surface disposed within said connecting portion to face said inside surface;

a driven member rotatably mounted on said housing and having a second cyclically undulated surface disposed annularly of said connecting portion to face said outside surface;

a flexible linear member adapted for carrying a load at a point along its length;

means fixing another point along the length of said linear member to said driven member for rotation therewith; and oscillator means positioned to traverse said first undulated surface to be driven thereby in reciprocation through said connecting portion when said drive member is rotated, and positioned to traverse said second undulated surface to drive said second member in rotation in response to said reciprocation; whereby said another point of said linear member will be driven in rotation with said driven member to move said load.

2. Apparatus as in claim 1, wherein said connecting portion has a plurality of radially extending apertures, and said oscillator means comprises a plurality of rollers respectively captured for radial reciprocation within said apertures.

3. Apparatus as in claim 2, wherein said drive member comprises a drive shaft and said first surface comprises a circumferential surface of a circular element eccentrically mounted annularly of said drive shaft.

4. Apparatus as in claim 3, wherein said connecting portion further comprises two axially-spaced runs of apertures, evenly angularly-spaced circumferentially about said connecting portion; and said drive member further comprises the respective circumferential surfaces of two like axially-spaced circular elements eccentrically mounted on said drive shaft.

5. Apparatus as in claim 4, wherein said circumferential surfaces have eccentricities which are 180° out of phase.

6. Apparatus as in claim 5, wherein said runs of apertures have pitches which are relatively angularly staggered.

7. Apparatus as in claim 1, wherein said driven member comprises a spool having a cylindrical drum portion and radially extending flange portions at opposite ends of said drum portion; and said means fixing another point comprises a dowel connecting said flanges at an interval away from said drum.

8. A winch or the like, comprising:

a hollow tubular housing having a plurality of generally radially directed apertures angularly-spaced about the circumference thereof;

A shaft rotatably mounted coaxially within said housing;

A cam mounted on said shaft for rotation therewith within said housing; said cam having an external cam surface facing said apertures;

a spool rotatably mounted coaxially about said and having an internal cyclically undulated surface annularly located facing said apertures;

A flexible linear member adapted for carrying a load at a point along its length; means fixing another point along the length of said linear member to said spool for rotation therewith; and a plurality of elements respectively captured within said apertures for simultaneously traversing said cam surface and said undulated surface; said elements and surfaces being relatively dimensioned, configured and adapted so that when said cam is rotated with said shaft, said elements will be reciprocated within said apertures radially of said housing by movement of said elements by said cam surface and said spool will be rotated by movement of said undulated surface by said elements to drive said linear member another point so that said point is brought closer to said housing.

9. In a winch assembly having a housing, a drive shaft, a drum rotatably mounted on said housing and to which a point of a load-carrying linear member is fixed for winding said linear member therearound, and drive means for rotating said drum relative to said housing by said shaft, the improvement comprising:

said housing having a hollow tubular portion having inside and outside diameter surfaces;

said drum being rotatably mounted on said housing annularly of said housing tubular portion and having a cyclically undulated surface disposed to face said outside diameter surface;

said drive shaft being rotatably mounted on said housing coaxially internally within said tubular portion; and said drive means comprising a cam mounted on said shaft within said tubular portion and having a cam surface disposed to face said inside diameter surface, and oscillator means captured by said tubular portion and being dimensioned, configured and adapted for traversing said cam surface to be driven by said cam in reciprocation through said tubular portion when said shaft is rotated, and for traversing said undulated surface for rotating said drum relative to said shaft and housing in response to said reciprocation.

10. The improvement as in claim 9, wherein said shaft has a plurality of generally radially directed apertures located at angularly-spaced intervals about its circumference, and said oscillator means comprises a plurality of roller elements respectively captured for radial reciprocation within said apertures.

11. A winch or the like, comprising:

a cage having oppositely disposed sideplates separated by a gap and connected at respective upper and lower positions by first and second elements extending laterally joining corresponding parts of said plates;

a spool assembly having a central drum section and outwardly and radially directed flanges located at opposite ends of said drum section;

means mounting said spool assembly to said sideplates rotatably within said gap and between said first and second elements;

a flexible linear member having upper and lower ends and a point along its length intermediate said ends; and means mounting said point to said spool assembly for rotation therewith;

said flexible linear member being wrapped at least partially circumferentially about said drum with a portion of said linear member between said point and said upper end extending tangentially from said drum about a side of said first element in an upward direction and with another portion of said linear member between said point and said lower end extending tangentially from said drum about a correspondingly opposite side of said second element in a downward direction; and being relatively dimensioned, configured and adapted so that rotation of said spool assembly relative to said cage will wind said linear element in double layers about said drum to draw said lower end toward said upper end.

12. Apparatus as in claim 11, wherein said first and second elements comprise first and second dowels joining said plates.

13. Apparatus as in claim 12, wherein said means mounting said point comprises a third dowel laterally extending between said flanges and separated by an interval from said drum, and said linear member is wrapped about said drum and through said interval about said third dowel so said portion extends in a first direction about said drum and said another portion extends in an opposite direction about said drum.

14. Apparatus as in claim 11, wherein said means mounting said spool assembly to said sideplates comprises said spool assembly being formed with parallel horizontally extending surfaces and said cage being formed with corresponding parallel horizontally extending rails for slidingly receiving said horizontally extending surfaces.

15. Apparatus as in claim 14, further comprising means preventing rotation of said spool assembly unless said horizontally extending surfaces are received on said rails so that said spool assembly is properly aligned with said cage.

16. Apparatus as in claim 15, wherein said spool assembly includes a central bore, at least one said sideplates includes a bore, and said means preventing rotation comprises means preventing rotation unless said central bore is coaxially aligned with at least one said sideplate bores.

17. Apparatus as in claim 16, wherein means preventing rotation comprises said central bore having a square cross-section with a diagonal dimension and said each sideplate bore having opposite parallel vertical straight edges separated by a distance greater than said diagonal dimension.

18. Apparatus as in claim 11, said drum section is an annular element having an inwardly facing first cyclically undulated surface; and wherein said spool assembly further comprises a housing having a tubular portion located concentrically internally of said drum section;

a first member rotatably mounted within said tubular portion and having an outwardly facing second cyclically undulated surface; and oscillating means located between said first and second undulated surfaces and being dimensioned, configured and adapted for traversing said second surface to be driven by said first member in reciprocation through said tubular portion when said first member is rotated, and for traversing said first surface for rotating said drum relative to said tubular portion in response to said reciprocation.

19. Apparatus as in claim 18, wherein said tubular portion has a plurality of apertures angularly-spaced circumferential about said tubular portion, and said oscillating means comprises a plurality of rollers respectively captured for radial reciprocation within said apertures.

* * * * *